US005846141A

United States Patent [19]

Morgan et al.

[11] Patent Number: 5,846,141

[45] Date of Patent: Dec. 8, 1998

[54] GOLF BALL

[75] Inventors: William E. Morgan, Barrington, R.I.; Steven Aoyama, Marion; Edmund A. Hebert, North Dartmouth, both of Mass.

[73] Assignee: Acushnet Company, Fairhaven, Mass.

[21] Appl. No.: 844,950

[22] Filed: Apr. 23, 1997

[51] Int. Cl.[6] ..... A63B 37/08; A63B 37/06; A63B 37/12; A63B 37/14

[52] U.S. Cl. ..... 473/377; 473/354; 473/365; 473/384

[58] Field of Search ..... 473/372, 377, 473/354, 365, 384

[56] References Cited

U.S. PATENT DOCUMENTS

| | | | |
|---|---|---|---|
| 4,201,384 | 5/1980 | Barber | 273/199 R |
| 4,940,238 | 7/1990 | Bradley | 273/199 R |
| 5,209,485 | 5/1993 | Nesbitt et al. | 273/218 |
| 5,255,922 | 10/1993 | Proudfit | 473/372 |
| 5,439,227 | 8/1995 | Egashira et al. | 473/377 X |
| 5,497,996 | 3/1996 | Cadorniga | 473/377 |
| 5,645,497 | 7/1997 | Sullivan et al. | 473/377 |

FOREIGN PATENT DOCUMENTS

WO 97/14476 4/1997 WIPO .

*Primary Examiner*—George J. Marlo
*Attorney, Agent, or Firm*—Pennie & Edmonds, LLP

[57] ABSTRACT

A golf ball having:

a core; and a cover having an exterior surface with a plurality of dimples;

wherein the core, the cover, and the dimples are correlated with respect to each other such that the golf ball has a coefficient of restitution greater than 0.791 measured at an incoming velocity of 143.8 ft/sec, an initial velocity greater than 255 ft/sec when tested under the conditions set forth in the Initial Velocity rule for golf balls established by the United States Golf Association, and the ball travels less than 280 yards when tested under the conditions set forth in the Overall Distance Standard for golf balls established by the United States.

23 Claims, 3 Drawing Sheets

GOLF BALL

TECHNICAL FIELD

This invention relates generally to golf balls, and more particularly, to golf balls having a high initial velocity and modified flight characteristics such that they remain within the Overall Distance Standard (ODS) established by the United States Golf Association.

BACKGROUND OF THE INVENTION

Golf balls are typically constructed of a single or double core that is tightly surrounded by a single or double cover. It is typical for a golf ball core to be of solid construction or wound construction. A solid core typically comprises polybutadiene and a wound core typically comprises a solid or liquid center and rubber threads tightly wound around the center. The methods of forming these cores are well known in the art. Traditionally, golf ball covers are made of polymeric materials. For instance, covers have traditionally been made of balata rubber, which may be natural balata, synthetic balata or a blend of natural and synthetic balata, or ionomers such as those sold under the trademark "SURLYN."

The Rules of Golf as approved by the United States Golf Association (USGA), includes the following rules that relate to golf ball construction:

a. Weight
The weight of the ball shall not be greater than 1.620 ounces avoirdupois (45.92 gm).

b. Size
The diameter of the ball shall be not less than 1.680 inches (42.67 mm). This specification will be satisfied if, under its own weight, a ball falls through a 1.680 inches diameter ring gauge in fewer than 25 out of 100 randomly selected positions, the test being carried out at a temperature of 23°+/−1° C.

c. Spherical Symmetry
The ball must not be designed, manufactured or intentionally modified to have properties which differ from those of a spherically symmetrical ball.

d. Initial Velocity
The velocity of the ball shall not be greater than 250 feet (76.2 m) per second when measured on apparatus approved by the United States Golf Association. A maximum tolerance of 2% will be allowed. The temperature of the ball when tested will be 23°+/−1° C.

e. Overall Distance Standard (ODS)
A brand of golf ball, when tested on apparatus approved by the USGA on the outdoor range at the USGA Headquarters under the conditions set forth in the Overall Distance Standard for golf balls on file with the USGA, shall not cover an average distance in carry and roll exceeding 280 yards (256 m) plus a tolerance of 6%.

The Initial Velocity rule test is well known. The test is conducted by conditioning a ball for a minimum of 3 hrs at 23°±1° C. The room in which the test is to be conducted is conditioned to 23°±2° C. The ball is then struck by a striking mass of approximately 250 lbs at a striker velocity of 143.8 ft/sec.

The Overall Distance Standard test for golf balls is conducted by striking the golf ball with a golf club having a lie of 55±2, a D2±1 swing weight, 11±10 loft angle, 13.3±1 oz. overall weight, 4.6±0.3 cycle per second vibrational frequency, 162±30 oz. in. moment of inertia, 43.5±20 club length, a laminated head construction, a cycolac insert, a dynamic still steel shaft, and an all-weather rubber grip. The clubhead velocity during the ODS test is about 160±0.5 ft/sec measured at the hosel of the club over the last 4 inches of travel prior to impact. The distance traveled is adjusted for zero wind and an ambient temperature of 75° F.

The flight of a golf ball is determined by many factors, but only three factors that are typically controlled by the golfer. By impacting the ball with a golf club, the golfer typically controls the speed of the golf ball, the launch angle and the spin rate. The launch angle sets the initial trajectory of the golf balls flight. The speed and spin of the ball give the ball lift which will define the balls overall flight path along with the weight and drag of the golf ball. Where the ball stops after being struck by a golf club also depends greatly on the weather and the landing surface the ball contacts.

Many golfers have what is termed a "low swing speed." This means that the club head speed at impact is relatively slow when compared to a professional golfer's. Typically, when driving a golf ball the average professional golf ball speed is approximately 234 ft/s (160 mph). A person having a low swing speed typically drives the ball at a speed less than 176 ft/s (120 mph). Upwards of thirty percent of all golfers today have swing speeds that produce drives of less than 210 yards. A person with a low swing speed has a low ball speed. His or her ball does not fly very far because of the lack of speed and lift.

Low weight golf balls have been suggested in the past, such as the Cayman Golf Company's SPECTRA™, the Ram LASER LIGHT®, and the Pinnacle EQUALIZER®. Low weight golf balls tend to improve the distance acquired by low swing speed golfers. When the club impacts the ball, conservation of momentum dictates that a lower weight ball will acquire greater velocity than a heavier ball. The trade off is that a low weight golf ball slows down faster due to drag, an effect which is magnified at higher speeds. As a result, low weight balls are not good for high swing speed players but can be beneficial for low swing speed players.

The other significant factor in golf ball flight is the weather. In particular, wind can have a significant effect on the flight of a golf ball. Old British golf balls (balls made before the USGA rules were adopted by the Royal and Ancient Golf Club of St. Andrews, Scotland) were typically made with a diameter of 1.620 inches. These balls were generally thought to have better flight characteristics in the wind due to their smaller diameter.

Prior art golf balls that exceed the ODS do so by virtue of exceeding one or more additional USGA rules such as size, weight or initial velocity. The prior art does not provide a golf ball that has been constructed to conform with the ODS rule and exceed the Initial Velocity rule. Such a ball can benefit recreational golfers who have a low swing speed or who play in windy conditions.

SUMMARY OF THE INVENTION

The objective of this invention is to provide a golf ball with improved playability. More particularly, it is an objective to provide a golf ball having modified flight characteristics to improve the playability of the ball. Another objective is to provide a golf ball with an increased initial velocity, but which satisfies the ODS set forth by the USGA.

A preferred embodiment provides a golf ball with a high initial speed but sufficient lift to alter the ball's flight path to conform with the ODS. This embodiment can render improved flight distance to a recreational golfer who has a slow swing-speed. The ball has high lift properties. It should weigh from about 1.35 to 1.62 ounces. It preferably has an elevated spin rate, which is achieved with a soft cover. More preferably, the ball has a cover with Shore D hardness of less than about 60, and a hard core, with a compression of above about 95. The cover preferably has high-lift dimples. The ball may also have a diameter of about 1.68 inches or greater to increase the available lifting surface.

Another embodiment provides a golf ball with improved playability during a windy day. This embodiment displays a high initial speed but has a sufficiently low lift-to-drag ratio such that it complies with the ODS parameters. This embodiment has low-lift/high-drag dimples. To improve the windy-day playability, the ball preferably has a minimal spin rate, which is produced by a hard cover. Preferably the cover has a Shore D hardness greater than about 65, and a soft core, with a compression below about 90. In a solid construction embodiment, the core is preferably polybutadiene based and comprises zinc diacrylate and calcium oxide to reduce the ball's compression and increase its initial velocity. The weight of the ball according to this embodiment may be greater than about 1.62 ounces, and its diameter, between about 1.62 and 1.68 inches.

DETAILED DESCRIPTION OF THE PREFERRED EMBODIMENTS

Figure 1:
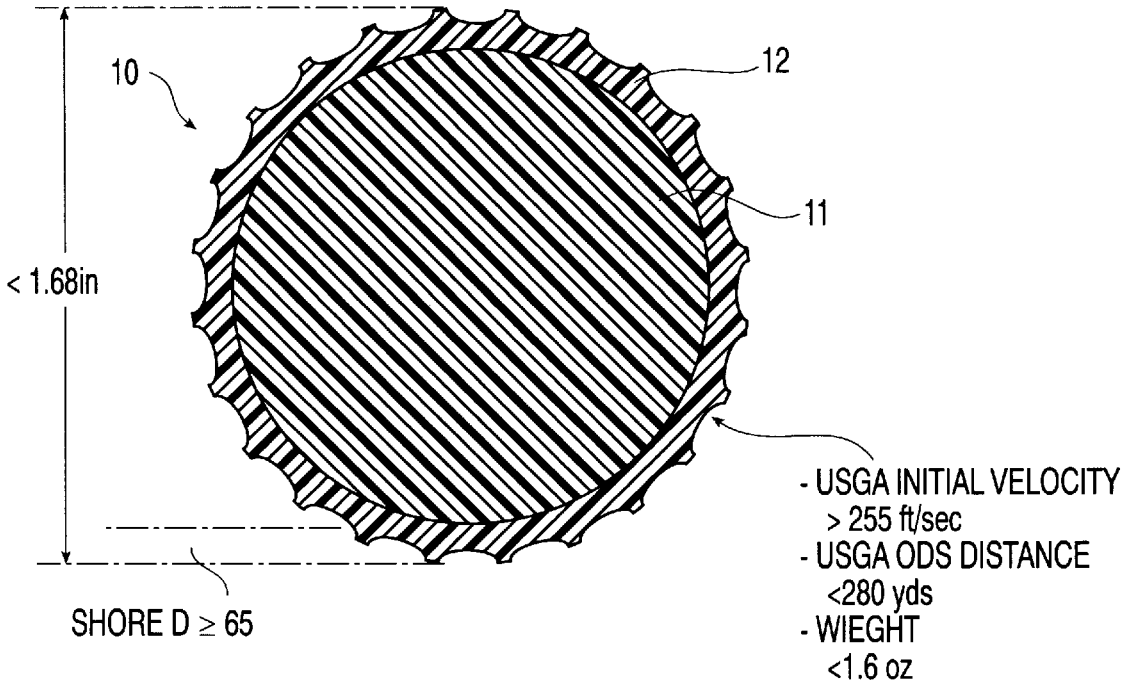
FIG. 1 is a cross-sectional view of an embodiment of a golf ball according to the present invention.

FIG. 1 shows a cross-section of golf ball 10 according to the present invention. Golf ball 10 is of solid construction and is comprised of a single or multiply layered core 11, and a single or multiply layered cover 12.

Figure 2:
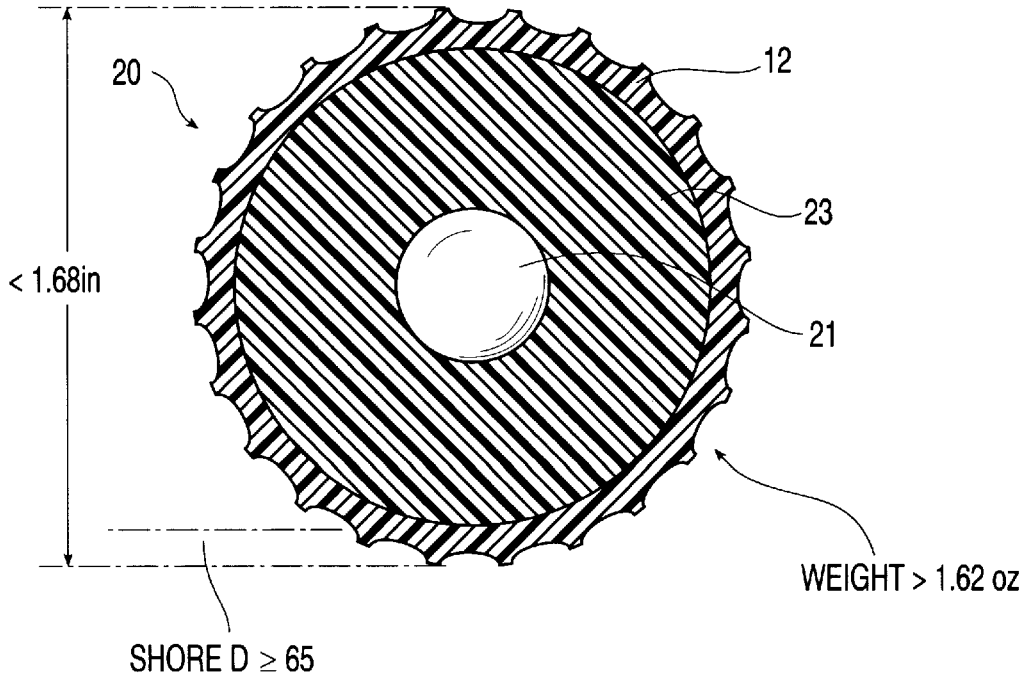
FIG. 2 is a cross-sectional view of a different embodiment of the golf ball according to the present invention.

FIG. 2 illustrates a cross-section of golf ball 20 according to the present invention and having a wound construction. The golf ball 20 is comprised of a center 21, a layer of wound rubber threads 23 that are tightly wound about the center 21 to increase the ball initial velocity and a single or multiply layered cover 12.

Figure 3:
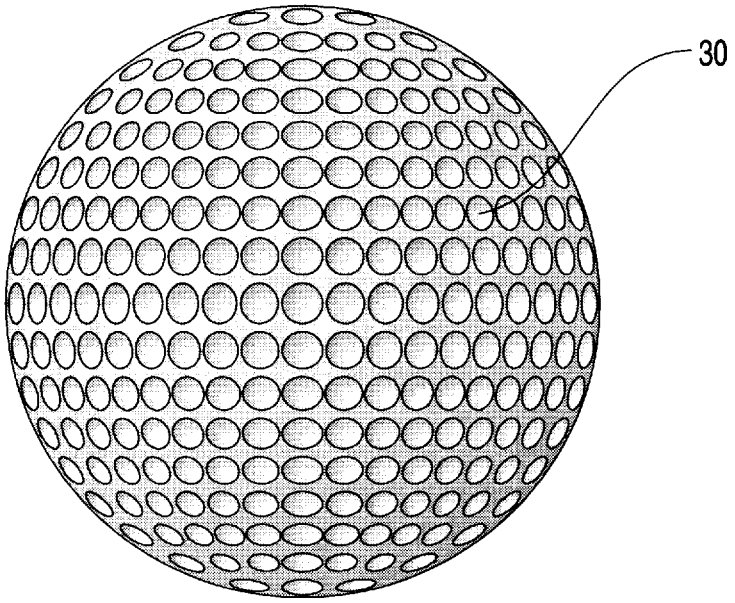
FIG. 3 is a perspective view of the golf ball according to the present invention.

FIG. 3 illustrates the outside of the cover 12 of either golf ball 10 or 20. In both the solid ball 10 and wound ball 20 embodiments, the covers 12 comprises a pattern of dimples 30.

Due to the construction of a golf ball according to this invention, when it is tested pursuant to the USGA rules, it exceeds the maximum allowable initial velocity of 255 feet per second (250 feet per second plus a 2% tolerance) under the Rules of Golf. The ball, however, will not cover more than the 280 yards prescribed by the ODS.

The initial velocity achieved by a golf ball when struck is related to the ball's coefficient of restitution. A common method of determining the coefficient of restitution is to shoot a ball out of an air cannon at a steel plate. The ball's rebound velocity is divided by the incoming velocity to determine the coefficient of restitution. A ball with a high coefficient of restitution dissipates a smaller fraction of the collision energy as heat than does a ball with a low coefficient of restitution. Thus, a high coefficient of restitution dictates a high initial ball-velocity.

In order to determine the maximum coefficient of restitution permissible for a ball to remain within the initial velocity rule, a series of four, highly resilient ball types were produced and sent to the USGA for testing. Two one-dozen samples of each of the ball types were independently tested for initial velocity and coefficient of restitution when the inbound speed was 143.8 ft/sec. The average initial velocity of the groups was 255.0 ft/sec, corresponding to the maximum allowed velocity of 250 ft/sec plus 2% test tolerance. The average coefficient of restitution when tested at an inbound speed of 143.8 ft/sec for these same groups was 0.791. Therefore, the maximum coefficient of restitution permissible for a ball to remain within the initial velocity rule is 0.791 when tested at a velocity of 143.8 ft/sec.

The maximum coefficient of restitution permissible ($C_{Rmax}$) for a ball to remain within the present initial velocity rules can be expressed as $$C_{Rmax}=1-0.00145({}^{sec}/_{ft})v$$

where v is the incoming velocity of the striking object measured in feet per second. Preferably, a golf ball according to the present invention exhibits a greater coefficient of restitution than $C_{Rmax}$:

$$C_R>1-0.00145({}^{sec}/_{ft})v$$

Preferably, for golf balls according to the present invention, then, the coefficient when tested at an impact velocity of 125 ft/sec will be greater than:

$$C_R>1-0.00145({}^{sec}/_{ft})125({}^{ft}/_{sec})$$

or, $$C_R>0.819.$$

In flight, a golf ball experiences the forces of gravity and aerodynamic drag and lift. Generally, drag and lift (D nd L) can be expressed as follows:

$$D={}^{1}/_{2}\rho C_D U^2 A$$

$$L={}^{1}/_{2}\rho C_L U^2 A$$

where $C_D$ and $C_L$ are drag and lift coefficients, ρ is air density, A is the cross-sectional area of the ball, and u is the velocity of the ball through the air.

High-Lift Embodiments

Figure 5:
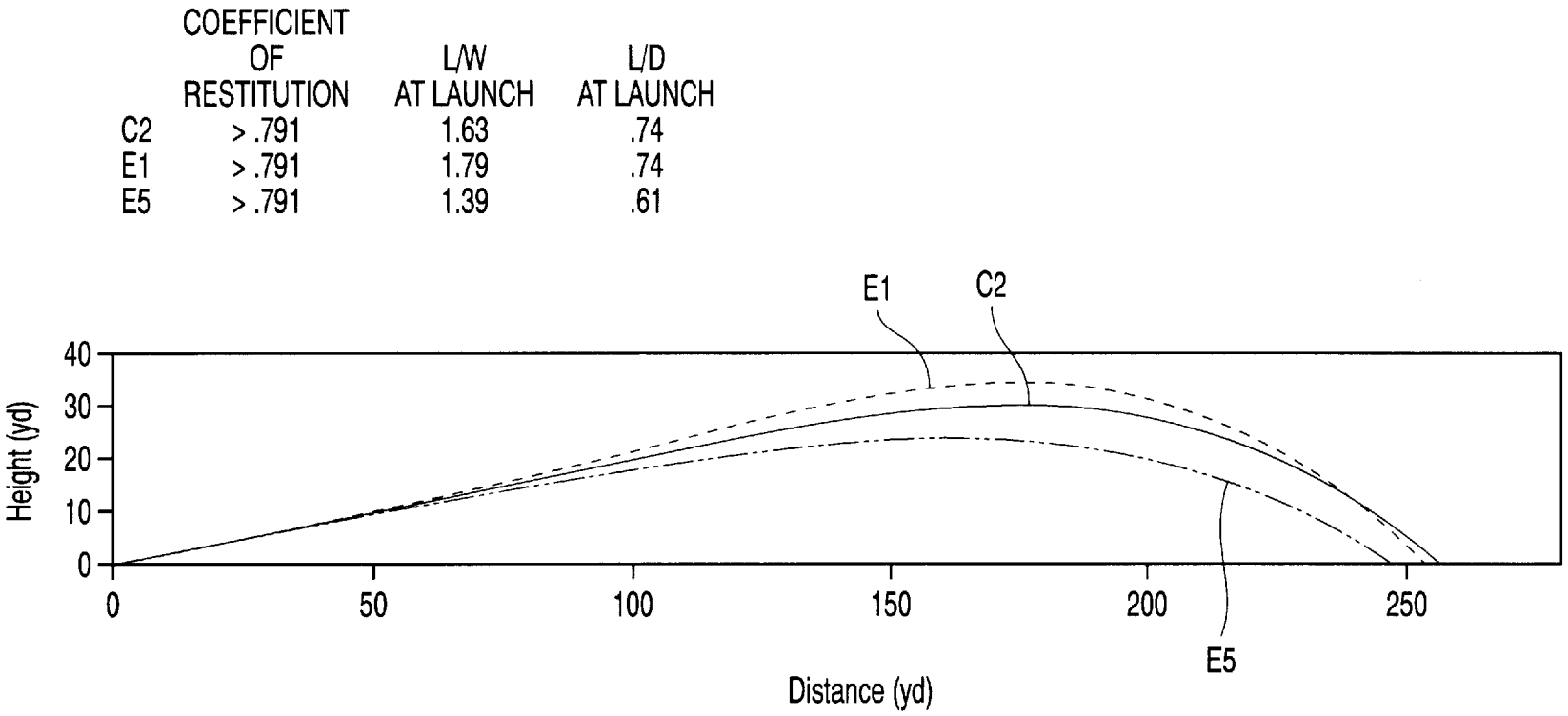
FIG. 5 is a graph comparing the flight paths of different embodiments of the invention.

In a high-lift embodiment, the ball 10, 20, or one constructed in a different manner, initially curves upwards sufficiently to restrict the distance it covers to a maximum of 280 yards when tested with a USGA approved apparatus. Referring to FIG. 5, the curve C2 depicts the flight trajectory of an otherwise standard golf ball with a high initial velocity exposed to the ODS test. Curve E1 shows the trajectory of a high-lift embodiment of the present invention in the same test. A ball with the E1 trajectory travels higher and lands in a shorter distance than a ball with a common C2 trajectory.

This high-lift aspect can benefit a golfer who has a low swing speed. When a low swing-speed golfer strikes a ball 10 or 20 of this embodiment using a driver type of club, the ball 10 or 20 provides a higher initial velocity than standard golf balls and a higher lift-to-weight ratio (L/W). The resulting higher trajectory will result in a greater distance covered by the ball 10 or 20 after the slow swing. The preferred L/W ratio of this embodiment is greater than about 1.12 at a spin rate of about 3000 rpm and a Reynolds number of about 160,000.

To accomplish this, the golf ball 10 or 20 has a decreased weight and an increased aerodynamic lift force. Increased lift is the result of the following factors: increased airspeed, spin, surface area, and/or the use of high lift dimples.

For the purposes of this invention, a low swing-speed golfer is considered to be one who has a swing that hits a ball at a speed of less than about 176 ft/sec. As an example for calculation purposes, a typical low swing-speed golfer is one who, when hitting a Pinnacle GOLD® golf ball using a driver type club, achieves a ball velocity of about 150 ft/sec, a launch angle from horizontal of about 14 degrees, and a spin rate of about 3,000 rpm. The 1996 Pinnacle GOLD® is a conventional solid construction distance ball manufactured by the Acushnet Company having a nominal size of 1.68 inches, a nominal weight of 1.62 ounces a cover flexural modulus of about 65,000 psi, and a compression of about 105.

A ball's lift coefficient is influenced quite strongly by spin. The greater the spin rate of the ball, the more lift is experienced. Cover material can have a dramatic effect on the spin imparted to a golf ball. A softer cover increases the spin. Softer cover materials include balata and very low modulus ionomers. However, various blends of cover materials can be mixed in order to provide optimum spin. It is preferred to use softer cover materials which have Shore D hardness of 65 or less. Cover materials for use in the present invention include those disclosed in U.S. Pat. Nos. 5,298,571; 5,120,791; 5,068,151; 5,000,549; 3,819,768; 4,264,075; 4,526,375; 4,911,451; 5,197,740; and 3,264,272. Among the preferred cover materials are ionomer resins such as those commercially available from DuPont Co. under the tradename SURLYN®. A presently preferred cover material is combination of about 50% SURLYN® 7940, a lithium ionomer made with 15% methacrylic acid and 50% SURLYN® 8320, a low modulus sodium ionomer. This cover has a cover hardness of about 60 Shore D.

Wound golf balls, such as depicted in FIG. 2, have been made with either solid or liquid centers 21. Solid centers 21 generally provide higher spin rates than liquid centers. The tension of the rubber thread windings is increased so that the ball coefficient of restitution is greater than 0.791 at a velocity of 143.8 ft/sec as discussed above.

A representative base composition for forming the golf ball core 11 in a ball 10 of solid construction, as shown in FIG. 1, or the center 21 in a wound ball 20 with a solid center, as shown in FIG. 2, comprises polybutadiene. In parts by weight based on 100 parts polybutadiene, the core 11 or center 21 comprises 20–50 parts of a metal salt diacrylate, dimethacrylate, or monomethacrylate, preferably zinc diacrylate. The polybutadiene preferably has a cis 1,4 content of above about 90% and more preferably above about 96%. Commercial sources of polybutadiene include Shell 1220 manufactured by Shell Chemical, Neocis BR40 manufactured by Enichem Elastomers, and Ubepol BR150 manufactured by Ube Industries, Ltd. If desired, the polybutadiene can also be mixed with other elastomers known in the art, such as natural rubber, styrene butadiene, and isoprene in order to further modify the properties of the core. When a mixture of elastomers is used, the amounts of other constituents in the core composition are based on 100 parts by weight of the total elastomer mixture.

Metal salt diacrylates, dimethacrylates, and monomethacrylates suitable for use in this invention include those wherein the metal is magnesium, calcium, zinc, aluminum, sodium, lithium or nickel. Zinc diacrylate is preferred, because it provides golf balls with a high initial velocity in the USGA test. The zinc diacrylate can be of various grades of purity. For the purposes of this invention, the lower the quantity of zinc stearate present in the zinc diacrylate the higher the zinc diacrylate purity. Zinc diacrylate containing less than about 10% zinc stearate is preferable. More preferable is zinc diacrylate containing about 4–8% zinc stearate. Suitable, commercially available zinc diacrylates include those from Rockland React-Rite and Sartomer. The preferred concentrations of zinc diacrylate that can be used are 30–50 parts per hundred (pph) based upon 100 parts of polybutadiene or alternately, polybutadiene with a mixture of other elastomers that equal 100 parts. Most preferred is a concentration of zinc diacrylate above about 40 pph to maximize the initial velocity of the ball. Other suitable compounds that increase initial ball-velocity include calcium oxide. The preferred high-lift embodiments, however, contain little or no calcium oxide because it softens the core and tends to reduce the ball's spin.

Higher compression cores or centers increase the spin rate of the ball. The preferred compression of the core 11 or center 21 is above about 95. Elevated concentrations of compounds such as zinc diacrylate and zinc oxide can be used to increase the compression of the core or center. Excessive zinc oxide, however, may increase the weight of the ball. The preferred amount of zinc oxide is therefore about 1 to 8 pph of polybutadiene.

Free radical initiators are used to promote cross-linking of the metal salt diacrylate, dimethacrylate, or monomethacrylate and the polybutadiene. Suitable free radical initiators for use in the invention include, but are not limited to peroxide compounds, such as dicumyl peroxide, 1,1-di (t-butylperoxy) 3,3,5-trimethyl cyclohexane, a—a bis (t-butylperoxy) diisopropylbenzene, 2,5-dimethyl-2,5 di (t-butylperoxy) hexane, or di-t-butyl peroxide, and mixtures thereof. Other useful initiators would be readily apparent to one of ordinary skill in the art without any need for experimentation. The initiator(s) at 100% activity are preferably added in an amount ranging between about 0.05 and 2.5 pph based upon 100 parts of butadiene, or butadiene mixed with one or more other elastomers. More preferably, the amount of initiator added ranges between about 0.15 and 2 pph and most preferably between about 0.25 and 1.5 pph. A typical prior art golf ball core incorporates 5 to 50 pph of zinc oxide in a zinc diacrylate-peroxide cure system that cross-links polybutadiene during the core molding process.

Antioxidants may also be included in the elastomer cores produced according to the present invention. Antioxidants are compounds which prevent the breakdown of the elastomer. Antioxidants useful in the present invention include, but are not limited to, quinoline type antioxidants, amine type antioxidants, and phenolic type antioxidants.

Golf balls 10 or 20 according to a high-lift embodiment weighs less than the USGA maximum weight for golf balls. This weight reduction may come from either the core 11 or center 21, the cover 12, or a combination of these. It is more advantageous to have the weight reduction of balls 10 or 20 in this embodiment result from less mass in the cover 12 so that the moment of inertia of the ball can be reduced to increase spin.

Fillers are commonly added to the golf ball cores or centers in order to bring the mass of the ball up to a mass that is close to the maximum specified by the USGA. Useful fillers include zinc oxide, regrind, which is recycled core molding matrix ground to 30 mesh particle size, and barium sulfate. To maximize the L/W ratio, it is preferred that a reduction in core 11 or solid center 21 mass be accomplished by reducing the amount of fillers that are added. Also, any filler can be added in a manner such that the density varies with distance from the center of the golf ball 10 or 20. For example, by making the density of the core 11 or center 21 smaller as the distance from the center increases it is possible to decrease the moment of inertia of the golf ball 10 or 20 to thereby increase the spin of the ball when hit.

Typical golf balls with solid polybutadiene cores or centers have a specific gravity of about 1.25. In one embodiment of the present invention, the core 11 or center 21 is preferably comprised of low weight polybutadiene having a specific gravity of less than about 1.1 and preferably, less than about 1.0.

In wound balls 20, liquid centers, having high compression, provide high initial velocities. The traditional liquid center for most wound golf balls has been a rubber sphere filled with a mixture of corn syrup, salt and water. Corn syrup and salt are added to increase the specific gravity of the center to values higher than 1. A low center 21 density is desirable to minimize weight. Low weight liquid centers, which are preferred in the high-lift embodiments, may use water only or a Barium Sulfate ($BaSO_4$) paste.

The preferred weight of golf balls to increase the LIW ratio ranges from about 1.35 to 1.62 ounces. More particularly, weights nearer the higher end of this range are preferable for golfers whose swing speeds are only moderately slow, while weights nearer the lower end of this range are preferable for golfers having very slow swing speeds.

The high-lift golf balls of these embodiments employ "high lift" dimples. For dimples of conventional spherical shape, high-lift dimples are those which are smaller and/or shallower than dimples traditionally used to cover the majority of the surface area of the ball, i.e. they have reduced depth and/or diameter than regular dimples.

Figure 4:
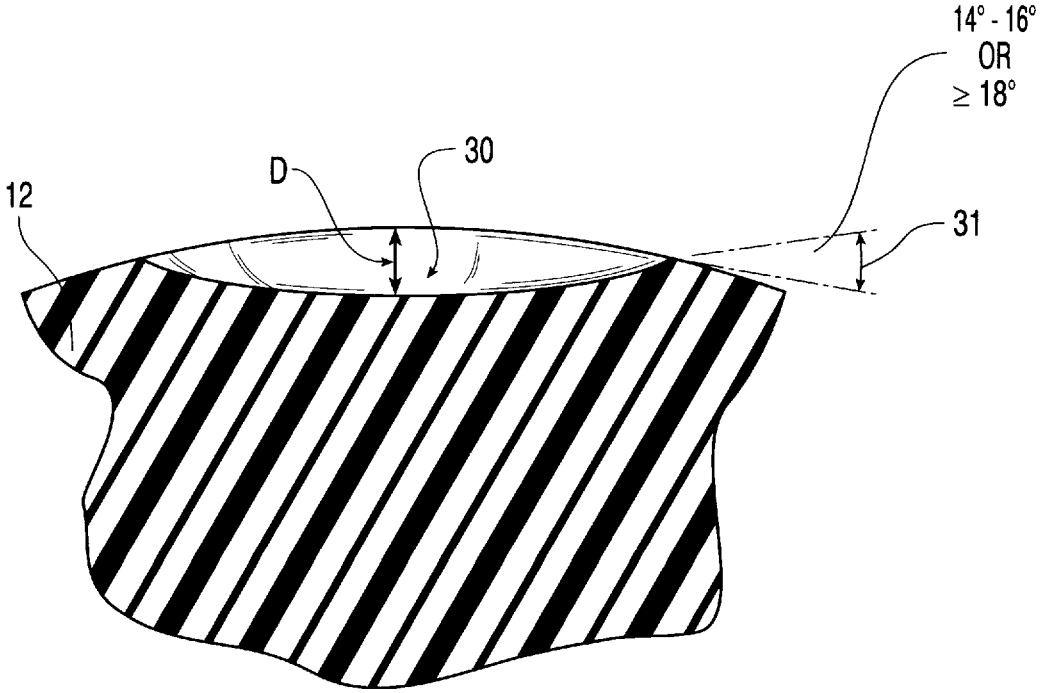
FIG. 4 shows a cross-sectional view of a dimple according to the invention.

Referring to FIG. 4, the depth D of the dimples 30 employed in the high-lift embodiments will tend to be shallower than usual, but can be any depth which will result in lift properties conducive to producing the desired enhanced loft trajectory. In particular, the high-lift dimples 30 preferably have a depth D of from about 0.004 inches to about 0.015 inches when measured from the phantom ball surface to the deepest part of the dimple 30. This presumes that the dimples 30 have a conventional spherical shape. Other shapes may require different depths to provide the desired lift properties. Furthermore, to maximize lift, the edge angle 31 of at least about 90% of the dimples 30 preferably form an angle of between 14 and 16 degrees to a tangent to the surface of the golf ball 10 or 20 adjacent to each dimple.

The number of dimples 30 on the surface of golf balls according to the present invention may also vary widely. The number of conventional spherical dimples 30 can be from about 100 to about 1000 or, more preferably, from about 300 to about 500. Most preferably, there are from about 332 to about 440 dimples 30 on the surface of golf balls according to the present invention. Other dimple shapes may require different numbers. A golf ball according to the invention may also comprise various sizes and shapes of dimples.

Since the depth and diameter of the dimples can be used to calculate the total dimple volume for a particular golf ball, the high lift dimples of the present invention can also be described by the total dimple volume they take up on a particular golf ball surface. This allows for the presence of a variety of different sized dimples.

If the dimples are spherical in shape, it is preferred that the total dimple volume of dimples according to these embodiments be from about 0.8% to about 2% of the total volume of the golf ball, or more preferably from about 1% to about 1.5%. In the most preferred mode to maximize the L/W ratio, the total dimple volume will be from about 1% to about 1.25%. As stated above the total dimple volume can be varied and is but one element of the claimed invention which may be adjusted depending on the other elements which affect the L/W ratio of the golf balls. Examples of specific dimple configurations that can be used in the golf balls of the present invention include those disclosed in U.S. Pat. Nos. 4,560,168, 5,158,300, 4,960,281, and 5,415,410, which are incorporated herein by reference. Moreover U.S. Pat. No. 4,729,861, which is also incorporated herein by reference, provides a detailed discussion of dimple theory and sets forth numerous different dimples which can be used in the present invention.

A further way to increase the L/W ratio involves enlarging the ball diameter. In this manner, the aerodynamic lifting surface of the ball is increased, increasing also the total lift. In an embodiment in which the size of the golf ball is enlarged but the weight remains unchanged, the amount of fillers must be decreased to reduce the ball's specific gravity and counteract the larger volume's effect on weight. Preferably, the diameter squared to weight ratio is about 1.76 or greater. Most preferably, the diameter squared to weight ratio is about 1.8 or greater.

Golf balls 10 or 20 as in these embodiments will achieve a maximum height when in flight that is greater than would a standard ball. That is, golf balls according to this embodiment of the invention will have a maximum height of greater than about 35 yards when tested under the ODS test conditions. Any factors which can increase the lift coefficient may be used in the high lift embodiments. Furthermore, the techniques described in the embodiments above may be combined to achieve the increased speed and lift accomplished by this invention, while remaining within the limits of the ODS.

Low Lift Embodiments

The invention provides a second manner of increasing the initial velocity of a golf ball 10 or 20 beyond the maximum allowable by the USGA rules, while limiting the distance the ball travels to within the ODS. Instead of increasing the L/W ratio to modify the flight path of the ball 10 or 20 such that it climbs too high to exceed the ODS, low-lift embodiments of the present invention achieve low lift to drag ratio (L/D) so that the ball 10 or 20 slows quickly, climbs little, and falls short of the ODS limit even though its initial velocity exceeds the maximum imposed by the rules. In FIG. 5, curve E5 represents the trajectory of a low-lift embodiment of the invention. A ball with this trajectory flies lower and lands in less distance than a normal ball that has a high speed, such as depicted by curve C2.

Golf balls of the low-lift embodiments may be of solid construction, as shown in FIG. 1, wound construction, as shown in FIG. 2, or any other type of construction known in the art. These golf balls are beneficial for use during windy weather because they spend less time in the air than do normal golf balls, thus the wind has a shorter time period in which to alter their flight paths, and the balls' trajectories are closer to the ground where the wind speed is generally lower. Certain embodiments may employ characteristics of windy-weather balls, such as a small diameter, high weight, and low spin, all of which tend to increase the distance covered by the ball. The L/D ratio in these embodiments, however, must be adjusted to compensate for the above factors' tendency to make the ball travel farther than the ODS permits.

Golf balls in these embodiments have minimal lift and high drag. Preferably, the L/D ratio is less than about 0.75 and most preferably less than 0.70 at a spin rate of 3000 rpm at a Reynolds number of 160,000. To attain this low ratio, high-drag/low-lift dimples are employed.

Referring to FIG. 3, for spherically shaped dimples 30, low-lift dimples are larger and deeper than dimples traditionally used to cover the majority of the surface area of the ball. More particularly, the dimples 30 according to this embodiment preferably have edge angles 31, illustrated in FIG. 4, of more than about 17° to a tangent to the surface of the golf ball 10 or 20, adjacent each dimple, and most preferably, of about 18° or greater. The dimples preferably enclose a total volume of more than about 1.25% of the volume of a sphere having the same diameter as the golf ball. The dimple pattern may be a basic octahedral pattern with a dimple free equator. This pattern presumes that the dimples 30 have a conventional spherical shape. Other shapes may require different depths and layouts to provide the desired decreased lift and increased drag properties. The dimple edge angles 31 and total enclosed volume can be varied and are but two elements of the claimed invention which can be adjusted depending on the other elements which affect the L/D ratio of the golf balls.

The number of dimples 30 on the surface of golf balls according to the present invention may also vary widely. The number of conventional spherical dimples 30 can range from about 100 to about 1000 or, more preferably, from about 300 to about 350. Other dimple shapes may require different numbers.

As discussed above, to reduce the effect of the wind on a ball, the ball's spin rate and diameter may be reduced, and its weight, increased. Referring to FIGS. 1 and 2, a low spin rate is achieved by providing a hard cover 12 and a soft core 11 or center 21. A wide variety of cover materials may be used in the present invention. Among the preferred conventional cover materials are ionomer resins. More particularly, ionomers, such as acid-containing ethylene copolymer ionomers, include E/X/Y copolymers where E is ethylene, X is a softening comonomer such as acrylate or methacrylate present in 0–50 (preferably 0–25, most preferably 0–2), weight percent of the polymer, and Y is acrylic or methacrylic acid present in 5–35 (preferably 10–35, most preferably 15–20) weight percent of the polymer, wherein the acid moiety is neutralized 1–90% (preferably at least 40%, most preferably at least about 60%) to form an ionomer by a cation such as lithium, sodium, potassium, magnesium, calcium, barium, lead, tin, zinc or aluminum, or a combination of such cations, lithium, sodium and zinc being the most preferred. Specific acid-containing ethylene copolymers include ethylene/acrylic acid, ethylene/methacrylic acid, ethylene/acrylic acid/n-butyl acrylate, ethylene/methacrylic acid/n-butyl acrylate, ethylene/methacrylic acid/iso-butyl acrylate, ethylene/acrylic acid/iso-butyl acrylate, ethylene/methacrylic acid/n-butyl methacrylate, ethylene/acrylic acid/methyl methacrylate, ethylene/acrylic acid/methyl acrylate, ethylene/methacrylic acid/methyl acrylate, ethylene/methacrylic acid/methyl methacrylate, and ethylene/acrylic acid/n-butyl methacrylate. Preferred acid-containing ethylene copolymers include ethylene/methacrylic acid, ethylene/acrylic acid, ethylene/methacrylic acid/n-butyl acrylate, ethylene/acrylic acid/n-butyl acrylate, ethylene/methacrylic acid/methyl acrylate and ethylene/acrylic acid/methyl acrylate copolymers. The most preferred acid-containing ethylene copolymers are ethylene/methacrylic acid, ethylene/acrylic acid, ethylene/(meth)acrylic acid/n-butyl acrylate, ethylene/(meth)acrylic acid/ethyl acrylate, and ethylene/(meth)acrylic acid/methyl acrylate copolymers.

The manner in which these ionomers are made is well known in the art as described in U.S. Pat. No. 3,262,272, for example. A preferred cover is comprised of a 50/50 blend of SURLYN® 8140 and SURLYN® AD 8546 (SEP671), which is a lithium SURLYN® having about 19% methacrylic acid. This material has a flexural modulus of about 105,000 psi. Preferably, the flexural modulus of the cover is greater than about 75,000 psi. Other preferred covers 12 include a cover 21 comprised of a 50/50 blend of SURLYN® AD 8546, which has about 19% methacrylic acid, and SURLYN® 9910 which is a standard zinc SURLYN®, and a cover comprised of high-acid SURLYN® AD 8546. Still further, the preferred cover has a hardness of greater than about 70 Shore D. The high flexural modulus of the cover 12 not only lowers the spin rate, but also provides increased initial velocity.

Soft cores produce low spin rates. The core 11 or center 21 of a low-lift embodiment ball has a reduced compression to slow the balls' spin and reduce lift. Preferably, the compression of the core 11 or center 21 is below about 90. If the compression of the ball as a whole drops too far, however, the initial velocity will similarly decrease. Thus the compression is soft enough to lower the ball's spin ratios, but not so soft as to bring the initial velocity in a USGA test below the 255 ft/sec maximum allowed under the rules.

In these embodiments, the zinc oxide (ZnO) may be reduced or eliminated in favor of calcium oxide (CaO) in the golf ball core composition. The cores 11 or centers 21 and balls 10 or 20 produced from such an admixture typically exhibit enhanced performance properties. The initial velocity of the standard ball is maintained above the maximum allowed by the USGA, but the compression of the ball is reduced by at least about 2 compression points and may be reduced by as much as 14 points. Where the amount of zinc oxide incorporated in prior art cores is, as noted above, typically about 5 to 50 pph, the amount of calcium oxide added to the core-forming composition of the invention as an activator is typically in the range of about 0.1 to 15, preferably 1 to 10, most preferably 1.25 to 5, parts calcium oxide per hundred parts (pph) of polybutadiene.

The low-lift embodiments may include sufficient fillers to increase the specific gravity of the core 11 or solid center 21 and thus to reduce the effect of the wind. An excessively dense core, on the other hand, would tend to increase the distance travelled by the ball. Consequently, the amount and specific gravity of the fillers must be limited to maintain the ball within the ODS. To decrease the wind's negative effect, the weight of the ball preferably exceeds 1.62 ounces, and most preferably 1.64.

Increasing the moment of inertia of the ball decreases the spin rate of the ball. The density of a preferred embodiment of the invention increases with the distance from the center, thereby raising the moment of inertia.

In a low-lift wound embodiment, the center 21 may be either liquid or solid. Liquid centers are preferred because they produce lower spin rates and higher initial velocities. The center 21's weight may be varied by dissolving substances in the water that increase the specific gravity, for example salt and corn syrup.

The diameter of the ball 10 or 20 may be decreased to lessen the effect of the wind on the ball's flight path. Reducing the size of the ball will also reduce its drag. Hence, the dimples 30 on the ball must be selected to limit the distance travelled by increasing drag and decreasing lift. A low-lift embodiment's diameter is preferably below 1.68 inches.

Any factors which can decrease the L/D ratio may be used to limit the distance traveled by ball 10 or 20 of low lift embodiments to ensure compliance with the ODS. The low lift embodiments should be configured such that the ball has a maximum flight height less than about 25 yards from the ground when tested under conditions set forth in the Overall Distance Standard for golf balls established by the United States Golf Association.

EXAMPLES

These and other aspects of golf balls according to the present invention may be more fully understood with reference to the following non-limiting examples, which are merely illustrative of the preferred embodiments of the present invention, and are not to be construed as limiting the invention, the scope of which is defined by the appended claims. These examples illustrate several of the above described manners in which to increase the L/W ratio or decrease the L/D ratio in order to limit the distance travelled by a golf ball that, according to the invention, has a high initial velocity.

The examples are computer models based on comparative example C1, a model of a typical, hard cover, solid construction, low spin, distance golf-ball. This category of golf balls includes the Pinnacle GOLD®, Titleist DT® 2-pc, and Titleist HVC®. In each model, different parameters were changed to reflect the performance of selected embodiments of the present invention. Table I sets forth the construction of each example and, to illustrate the effect of changing the dimple pattern, the L/W and L/D ratios of each example's configuration at a standardized 3000 rpm and 160,000 Reynolds number. Table II shows the performance of each example under the ODS test. Tables III and IV, show the performance of high lift examples E1, E2, E3, and E4 under the launch conditions imposed respectively by a typical golfer and by a slow swing-speed golfer. Table V compares the performance of low-lift embodiments E5, E6, and E7 with the performance of comparative example C1 under the ODS launch conditions, but with a 20 mph headwind. The launch conditions in Tables II, III, IV, and V are defined by the initial velocity, launch angle, and spin rate achieved by the example C1, an existing ball, described below, in the respective launches.

The first comparative example C1 is standard size and weight: 1.680 inches diameter, and 1.620 ounces weight. It has 440 dimples in multiple sizes that have edge angles of near 16°, cover about 70% of the ball surface, and enclose a total volume of about 0.0310 $in^3$, or 1.25% of the volume of a sphere having an equal diameter to the ball's. This pattern results in a L/W ratio of 1.12 and a L/D ratio of 0.77 at a Reynolds number of 160,000 and a spin rate of about 3000 rpm. The ball's $C_R$ is approximately 0.787 at an inbound velocity of 143.8 ft/sec. This ball passes all USGA tests.

Due to the different launch conditions in the ODS test and the velocity test, a ball's initial velocity in the ODS test is lower than in the velocity test. The first comparative example C1, which possesses an initial velocity near the 255 ft/sec limit in the velocity test, has an initial velocity in the ODS test of only 235.0 ft/sec.

Experience has shown that balls with an ODS velocity of 235 ft/sec pass the initial velocity test very close to the limit. Balls that are 2% faster thus exceed the initial velocity limit plus the allowed tolerance. The initial velocities of the other examples, C2 and E1–E7, are about 2% higher than that of the first example C1, both in USGA tests and when hit by a club, although only the velocity increase in the ODS test is shown in the tables.

The second comparative example C2 is similar to the first C1, except that the core formulation has been modified to achieve a $C_R$ of approximately 0.823 at the inbound velocity of 143.8 ft/sec, resulting in a ball velocity increase of nearly 2%. Each of the following examples share the same $C_R$ as example C2.

The four embodiments E1–E4 exemplify the high-lift type balls. The first-embodiment E1 is the same as C2, but has a modified high-spin type construction, attained by providing a wound core and a soft cover having a Shore D hardness below 60. This construction raises the spin rate nearly 23% and launches at a lower angle than C2 when struck with a driver.

The second embodiment E2 is like a ball C2 but has an altered core formulation to reduce the weight to 1.55 ounce.

The third embodiment E3 is similar to C2, but has a high lift dimple configuration resulting in a L/W of about 1.23 at a Reynolds number of 160,000 and a 3,000 rpm spin rate. The total dimple volume enclosed is lowered to 1.17% of the volume of a sphere with the ball's diameter, or 0.0290 $in^3$.

The fourth embodiment E4, is a C2-type ball, with a larger diameter of 1.720 inches, but an unchanged weight and absolute total-enclosed dimple-volume, i.e., 0.0310 $in^3$. Thus, the dimple volume as a percentage of a sphere is lowered.

The three embodiments E5–E7 are of the low-lift type. Each of these embodiments features low-lift/high-drag dimples combined with a feature that improves the ball's high-wind performance. These high-wind features by themselves tend to increase the distance travelled by the ball. Thus, in an embodiment (not tabulated) comprising only an increased initial velocity, and low-lift/high-drag dimples, but no additional feature, would still satisfy the ODS.

Embodiment E5 is a C2 type ball but modified to have a low spin-rate, for example by providing a very soft core and a hard cover. The dimple pattern is changed to have an edge angle of 18° and a dimple volume of 1.41% the volume of a sphere having the same diameter as the ball, i.e., a 0.0349 $in^3$ total enclosed dimple-volume. This construction spins approximately 10% less than an unmodified example C2 and launches at a slightly increased angle.

Embodiment E6 has the same dimple pattern as E5 and a construction like example C2, but its weight has been increased to 1.67 ounces to diminish the wind's influence.

The last example, embodiment E7, shares C2's construction, but has a smaller diameter, dimples with edge angles of 20°, and a total enclosed dimple-volume of 1.57% of the volume of a sphere with the diameter of the ball, in this case, a dimple volume of 0.0324 $in^3$.

When subjected to the ODS, each embodiment according to the present invention travels a total distance of less than the maximum 280 yards prescribed in the rule, albeit its increased initial velocity. As defined above, this total distance is the sum of the distances the ball flies and rolls. Only the second comparative example C2, which has normal flight characteristics, exceeds the ODS rule. This example C2 does not employ the inventive features of the present invention. In spite of their increased velocity, however, the high-lift embodiments E1–E4 show improved distance when compared to baseline example C1 when struck at real-world launch conditions by a golfer with a typical or low swing-speed, and the low-lift embodiments E5–E7, tailored to high wind environments, exceeded the distance travelled by C1 where there is an increased headwind.

TABLE I

Ball Construction

TABLE I

| | Ball Construction | | | | | | |
|---|---|---|---|---|---|---|---|
| | | | Dimples | | | At 3000 rpm and 160,000 Re | |
| | Spin Type Construction | Ball Weight (oz) | Edge Angle | % of sphere volume | Ball Diameter (in) | L/W | L/D |
| C1 | Low Spin | 1.62 | 16° | 1.25 | 1.68 | 1.12 | .77 |
| C2 | Low Spin | 1.62 | 16° | 1.25 | 1.68 | 1.12 | .77 |
| E1 | High Spin | 1.62 | 16° | 1.25 | 1.68 | 1.12 | .77 |
| E2 | Low Spin | 1.55 | 16° | 1.25 | 1.68 | 1.17 | .77 |
| E3 | Low Spin | 1.62 | 15° | 1.17 | 1.68 | 1.23 | .81 |
| E4 | Low Spin | 1.62 | 16° | 1.16 | 1.72 | 1.12 | .77 |
| E5 | Very Low Spin | 1.62 | 18° | 1.41 | 1.68 | 1.04 | .68 |
| E6 | Low Spin | 1.67 | 18° | 1.41 | 1.68 | 1.01 | .68 |
| E7 | Low Spin | 1.62 | 20° | 1.57 | 1.58 | 1.00 | .63 |

TABLE II

Overall Distance Standard Launch Condition

TABLE II

| | Overall Distance Standard Launch Condition | | | | | |
|---|---|---|---|---|---|---|
| | Launch Conditions | | | | | |
| Example | Ball Speed (ft/sec) | Angle | Spin (rpm) | At Launch L/W | At Launch L/D | Total Distance (yd) |
| C1 | 235 | 9.0° | 3,000 | 1.59 | .74 | 277.2 |
| C2 | 240 | 9.0° | 3,000 | 1.63 | .74 | 283.6 |
| E1 | 240 | 8.8° | 3,700 | 1.79 | .79 | 278.9 |
| E2 | 240 | 9.0° | 3,000 | 1.70 | .74 | 277.5 |
| E3 | 240 | 9.0° | 3,000 | 1.79 | .77 | 279.3 |
| E4 | 240 | 9.0° | 3,000 | 1.68 | .74 | 278.6 |
| E5 | 240 | 9.1° | 2,700 | 1.39 | .61 | 275.8 |
| E6 | 240 | 9.0° | 3,000 | 1.42 | .65 | 279.8 |
| E7 | 240 | 9.0° | 3,000 | 1.33 | .60 | 276.9 |

TABLE III

Typical Golfer Launch Condition

TABLE III

| | Typical Golfer Launch Condition | | | | |
|---|---|---|---|---|---|
| | Launch Conditions | | | L/W | Total |
| Example | Ball Speed (ft/sec) | Angle | Spin (rpm) | at Launch | Distance (yd) |
| C1 | 185 | 9.0° | 3,000 | 1.12 | 203.7 |
| E1 | 189 | 8.8° | 3,700 | 1.34 | 207.5 |
| E2 | 189 | 9.0° | 3,000 | 1.21 | 206.8 |

TABLE III-continued

| | Typical Golfer Launch Condition | | | | |
|---|---|---|---|---|---|
| | Launch Conditions | | | L/W | Total |
| Example | Ball Speed (ft/sec) | Angle | Spin (rpm) | at Launch | Distance (yd) |
| E3 | 189 | 9.0° | 3,000 | 1.27 | 209.4 |
| E4 | 189 | 9.0° | 3,000 | 1.19 | 207.3 |

TABLE IV

Slow Swing-Speed Golfer Launch Condition

TABLE IV

| | Slow Swing-Speed Golfer Launch Condition | | | | |
|---|---|---|---|---|---|
| | Launch Conditions | | | L/W | Total |
| Example | Ball Speed (ft/sec) | Angle | Spin (rpm) | at Launch | Distance (yd) |
| C1 | 150 | 14.0° | 3,500 | 1.01 | 158.3 |
| E1 | 153 | 13.7° | 4,300 | 1.16 | 160.0 |
| E2 | 153 | 14.0° | 3,500 | 1.07 | 160.8 |
| E3 | 153 | 14.0° | 3,500 | 1.13 | 162.3 |
| E4 | 153 | 14.0° | 3,500 | 1.05 | 161.3 |

TABLE V

ODS Launch Condition

With 20 MPH Headwind

TABLE V

| | ODS Launch Conditions With 20 MPH Headwind | | | | |
|---|---|---|---|---|---|
| | Launch Conditions | | | L/D | Total |
| Example | Ball Speed (ft/sec) | Angle | Spin (rpm) | at Launch | Distance (yd) |
| C1 | 235 | 9.0° | 3,000 | .75 | 235.5 |
| E5 | 240 | 9.1° | 2,700 | .63 | 238.3 |
| E6 | 240 | 9.0° | 3,000 | .67 | 241.8 |
| E7 | 240 | 9.0° | 3,000 | .60 | 243.3 |

For comparison of the different aspects of the present invention, FIG. 5 illustrates the flight paths, not the subsequent rolls, of comparative example C2 and embodiments E1 and E5 under the ODS test conditions.

It will be appreciated that those skilled in the art may devise numerous modifications and embodiments. It is intended that the following claims cover all such modifications and embodiments as fall within the true spirit and scope of the present invention.

We claim:

1. A golf ball, comprising:

a core; and a cover having an exterior surface with a plurality of dimples;

wherein the core, the cover, and the dimples are correlated with respect to each other such that said golf ball has an initial velocity greater than 255 ft/sec when tested under the conditions set forth in the Initial Velocity rule for golf balls established by the United States Golf Association, and said ball travels less than 280 yards when tested under the conditions set forth in the Overall Distance Standard for golf balls established by the United States Golf Association.

2. The golf ball of claim 1, wherein the ball has a ratio of aerodynamic lift force to ball weight that is greater than about 1.12 at a spin rate of about 3000 rpm and a Reynolds Number of about 160,000.

3. The golf ball of claim 2, wherein at least 90% of the dimples have an edge angle of about 14 to 16 degrees to the exterior surface.

4. The golf ball of claim 2, wherein the cover comprises a material having a Shore D hardness of about 65 or less.

5. The golf ball of claim 2, wherein the ball has a weight of less than about 1.6 ounces.

6. The golf ball of claim 2, wherein the ball has a predetermined diameter and wherein said dimples enclose a total volume from about 1% to 1.25% of the volume of a sphere having a diameter equal to the ball's predetermined diameter.

7. The golf ball of claim 1, wherein the ball has a ratio of aerodynamic lift force to aerodynamic drag force of less than about 0.7 at a spin rate of about 3000 rpm and a Reynolds Number of about 160,000.

8. The golf ball of claim 7, wherein the cover comprises a material having a Shore D hardness of about 65 or greater.

9. The golf ball of claim 7, wherein the ball has a weight greater than about 1.62 ounces.

10. The golf ball of claim 7, wherein the ball has a diameter being less than about 1.68 inches.

11. The golf ball of claim 7, wherein the ball has a predetermined diameter and wherein said dimples enclose a total volume greater than about 1.25% of the volume of a sphere having a diameter equal to the ball's predetermined diameter.

12. The golf ball of claim 11, wherein at least 90% of the dimples have an edge angle of more than about 18 degrees to the exterior surface.

13. The golf ball of claim 1, wherein the ball has a coefficient of restitution greater than $$1-0.00145(^{sec}/_{ft})v$$

at an incoming velocity of v, wherein v is measured in feet per second.

14. A golf ball, comprising:

a core having a predetermined specific gravity and a predetermined compression; and a cover comprised of a material with a predetermined hardness and having an exterior surface with a plurality of dimples;

wherein the golf ball has a weight of about 1.62 ounces or less, a diameter of about 1.68 inches or greater, an initial velocity greater than 255 ft/sec when tested under the conditions set forth in the Initial Velocity rule for golf balls established by the United States Golf Association, and the specific gravity and the compression of the core and the hardness of the cover are correlated to each other such that the golf ball travels less than 280 yards when tested under the conditions set forth in the Overall Distance Standard for golf balls established by the United States Golf Association.

15. The golf ball of claim 14 wherein the core specific gravity and the dimples are correlated to each other such that the ball has a ratio of aerodynamic lift force to ball weight greater than about 1.12 at a spin rate of about 3000 rpm and a Reynolds Number of about 160,000.

16. A golf ball, comprising:

a core having a predetermined specific gravity; and a cover comprising a material with a predetermined hardness and having an exterior surface defining a ball diameter and having a plurality of dimples;

wherein the ball has a coefficient of restitution greater than 0.791 measured at an incoming velocity of 143.8 ft/sec against a steel plate, and the specific gravity of the core, the hardness of the cover, and the dimples are correlated to each other such that the ball has a maximum flight height greater than about 35 yards from the ground and travels less than 280 yards when tested under the conditions set forth in the Overall Distance Standard for golf balls established by the United States Golf Association.

17. The golf ball of claim 16, wherein at least 90% of the dimples have an edge angle of about 14 to 16 degrees to the exterior surface and the dimples enclose a total volume from about 1 to 1.25% of the volume of a sphere having a diameter equal to the ball's predetermined diameter such that the golf ball has a ratio of aerodynamic lift force to ball weight that is greater than about 1.12 at a spin rate of about 3000 rpm and a Reynolds Number of about 160,000.

18. The golf ball of claim 16, wherein the ball has an overall weight correlated to the diameter of the ball to provide a ratio of diameter squared to weight of about 1.76 inches squared per ounce or greater.

19. The golf ball of claim 18, wherein the ball has an overall weight correlated to the diameter of the ball to provide a ratio of diameter squared to weight of about 1.8 inches squared per ounce or greater.

20. A golf ball, comprising:

a core; and a cover comprising of a material having a predetermined flexural modulus and having an exterior surface defining a ball diameter and having a plurality of dimples;

wherein the golf ball has a coefficient of restitution greater than 0.791 measured at an incoming velocity of 143.8 ft/sec against a steel plate, and the flexural modulus of the cover and the dimples are correlated such that the golf ball has a maximum flight height less than about 25 yards from the ground and travels less than 280 yards when tested under the conditions set forth in the Overall Distance Standard for golf balls established by the United States Golf Association.

21. The golf ball of claim 20, wherein the flexural modulus of the cover is about 75,000 psi or greater and the dimples preferably enclose a total volume of about 1.25% or more of a sphere having the same diameter as the ball such that the ball has a lift to drag ratio of less than about 0.7.

22. The golf ball of claim 21, wherein at least 90% of the dimples have an edge angle of about 18 degrees or greater to the exterior surface.

23. A golf ball, comprising:

a core; and a cover having an exterior surface with a plurality of dimples;

wherein the core, the cover, and the dimples are correlated with respect to each other such that said golf ball has an initial velocity greater than 255 ft/sec when struck by a 250 lb striker that has a striker velocity of 143.8 ft/sec in a room maintained at about 23° C. while the ball is maintained at about 23° C.; and wherein the ball travels less than 280 yards when struck by a golf club with a hosel and having a lie of about 55, about a D2 swing weight, about 11° loft angle, about 13.3 oz. overall weight, about 4.6 cycle per second vibrational frequency, about 162 oz. in. moment of inertia, about 43.5 club length, a laminated head construction, a cycolac insert, a dynamic still steel shaft, and an all-weather rubber grip, at a club head velocity of about 160 ft./sec measured at the hosel over the last 4 inches of travel prior to impact, with substantially zero wind and at an ambient temperature of 75° F.

* * * * *